United States Patent [19]

Hope et al.

[11] 4,255,039

[45] Mar. 10, 1981

[54] PHOTOGRAPHIC FILM AND PAPER PROCESSING EQUIPMENT

[76] Inventors: Henry F. Hope; Stephen F. Hope, both of 2421 Wyandotte Rd., Willow Grove, Pa. 19090

[21] Appl. No.: 74,784

[22] Filed: Sep. 12, 1979

[51] Int. Cl.[3] ..... G03D 3/04

[52] U.S. Cl. ..... 354/320; 354/328; 366/279

[58] Field of Search ..... 354/319, 320, 321, 322, 354/328, 324; 366/279, 314; 134/64 P, 122 P

[56] References Cited

U.S. PATENT DOCUMENTS

| | | | |
|---|---|---|---|
| 3,133,490 | 5/1964 | Buck | 354/328 |
| 3,532,048 | 10/1970 | Hope et al. | 354/320 |
| 3,538,836 | 11/1970 | Haiger | 134/122 P |
| 3,760,705 | 9/1973 | Miller | 354/322 |
| 4,026,451 | 5/1977 | Hope et al. | 354/320 |
| 4,156,569 | 5/1979 | Fasano | 354/328 |

*Primary Examiner*—L. T. Hix
*Assistant Examiner*—Alan Mathews
*Attorney, Agent, or Firm*—Zachary T. Wobensmith, 2nd; Zachary T. Wobensmith, III

[57] ABSTRACT

Equipment is provided for processing of photographic film and paper using roller transport systems which transport the photographic film and paper through a succession of processing tanks with liquids therein for processing and in which the respective liquids are agitated simultaneously with the operation of the transport systems by agitators within the tanks.

6 Claims, 10 Drawing Figures

PHOTOGRAPHIC FILM AND PAPER PROCESSING EQUIPMENT

BACKGROUND OF THE INVENTION

1. Field of the Invention

This invention relates to roller transport equipment for processing of photographic film and paper in tanks which equipment includes internal structure for agitation of the liquid in the tanks.

2. Description of the Prior Art

Equipment has been developed for processing of photographic film and paper by use of roller transport systems for advancing the photographic film and paper for developing, fixing and washing. In some equipment a large number of tanks are required in succession. One such roller transport structure is shown in our prior U.S. Pat. No. 3,532,048. In such equipment it has been customary to provide spaced from the tank and connected thereto by piping for removal at one location and return at another location for agitating the liquid in the tank for distribution to the film or paper being advanced in the roller transport system. This type of pump installation is expensive since it requires a pump, motor, electrical leads, plumbing and controls for each tank.

It has also been proposed to provide a flat elongated paddle horizontally rotatable about a central longitudinal axis within the tanks on the side of the rack and of a length substantially equal to the width of the rack but this did not prove satisfactory and is no longer used.

The structure of our invention can be contained in each tank in which photographic film or paper is processed and provides inexpensive liquid agitation for each roller transport tank.

SUMMARY OF THE INVENTION

In accordance with the invention photographic film and paper processing equipment is provided which includes roller transport equipment with roller transport racks in individual tanks for advancing photographic film or paper for processing while simultaneously and positively agitating the liquid in the tank by an agitator within the tank and preferably comprising an impeller having a plurality of blades at the bottom of the tank.

The principal object of the invention is to provide photographic film and paper processing equipment of the roller transport type with each roller transport tank having self-contained agitation apparatus driven by structure within the tank.

A further object of the invention is to provide equipment of the character aforesaid that is simple and inexpensive to construct but sturdy and reliable in operation.

A further object of the invention is to provide equipment of the character aforesaid which can be used with both new and existing roller transport systems.

A further object of the invention is to provide equipment of the character aforesaid which provides improved agitation of the liquid used for processing photographic film and paper.

A further object of the invention is to provide equipment in which the direction of agitation and the extent of agitation can be quickly changed, if desired.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
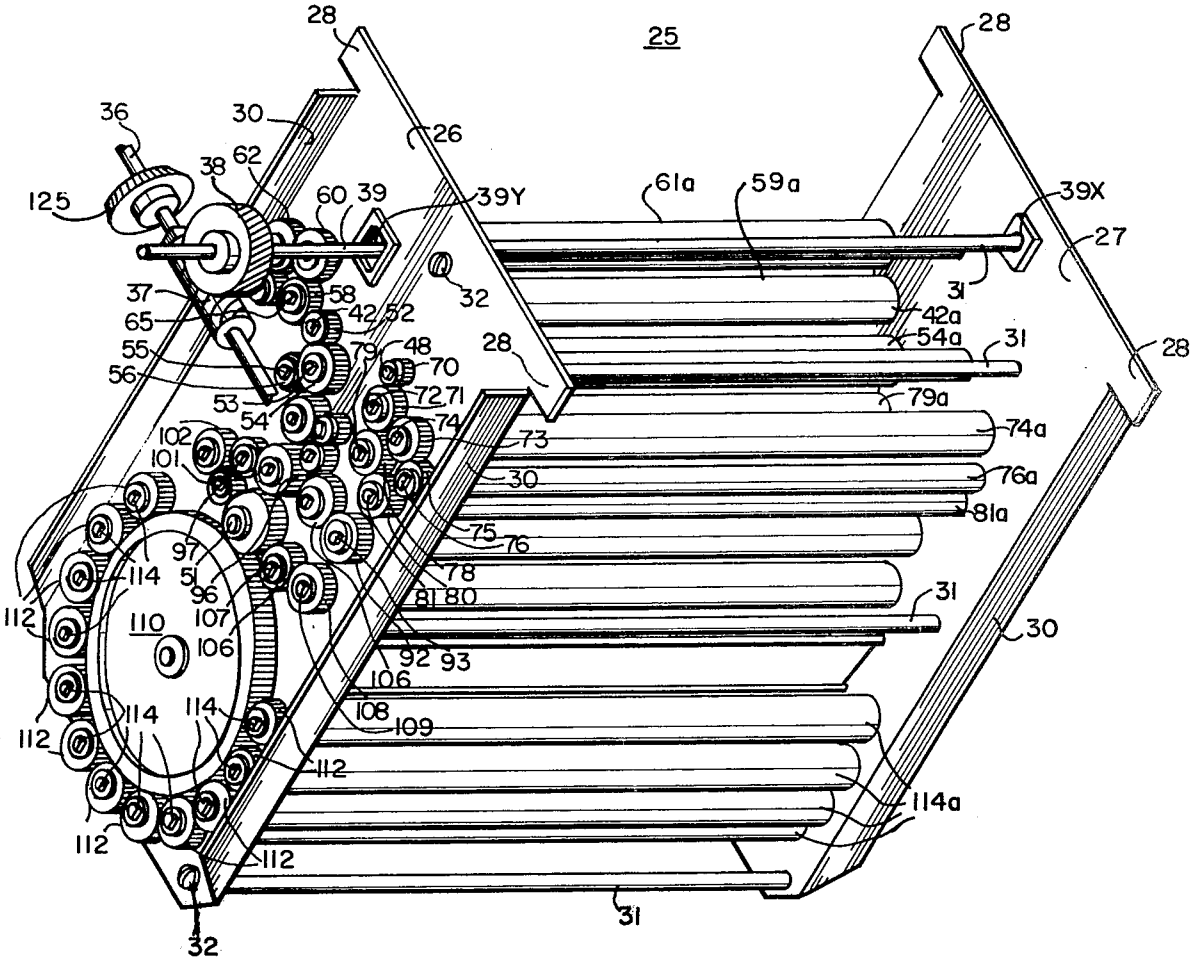
FIG. 1 is a view in perspective of one form of roller transport rack suitable for use with the photographic film and paper processing equipment of the invention.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings the photographic film and paper processing equipment of the invention is illustrated, which includes a plurality of rectangular tanks 10, preferably fabricated of stainless steel with front walls 11, rear walls 12, side walls 14 and 15 and bottom walls 16.

The tanks 10 can be mounted in the machine in any desired manner, and as illustrated are supported from the bottom by feet 20 resting on a frame bar 21 of a frame 22 of the apparatus. Within the tanks 10, roller transport racks 25 are provided which include rack side plates 26 and 27 carried on the tanks 10 by hooks 28 which extend over the front and rear walls 11 and 12, thereby suspending the racks 25 in the tanks 10. The side plates 26 and 27 are of generally rectangular shape with forwardly extending plates 30 from which the hooks 28 extend. The side plates 26 and 27 are held together by rods 31 and studs 32 threaded into the rods 31.

Adjacent the rack side plate 26 a longitudinally disposed input shaft 36 is provided which is connected to a drive motor (not shown). The shaft 36 has a worm gear 37 thereon engaged with a gear 38 carried on a shaft 39 to drive the roller transport rack 25. The shaft 39 is preferably pivotally journaled at 39*x* in the side plate 26 and extends across the rack 25 to plate 27 where it extends through the plate 27 at 39*y* and is preferably movably mounted with respect thereto for detachable engagement with gear 37. At the other end of the shaft 39 a gear 40 is provided. The shaft 39 is detachably retained in a bracket 120 on the frame 22.

The gear 40 is engaged with a larger diameter gear 41 carried on a shaft 42. The gear 41 is engaged with a gear 43 on a shaft 44 and a gear 45 on a shaft 46. The gear 45 is engaged with a still larger diameter gear 50 on a shaft 51, shafts 42, 44, 46 and 51 all being journaled in side plate 27. The shaft 42 extends to rack side plate 26 and has a gear 52 thereon of smaller diameter than gear 41 with a roller 42*a* on a shaft 42.

The gear 52 is engaged with a gear 53 of larger diameter mounted on shaft 54, with roller 54*a* thereon, shaft 54 extending back to and being journaled in side plate 27. The gear 53 is engaged with a gear 55 of smaller diameter mounted on shaft 56 with roller 56*a*, the shaft 56 extending to and being journaled in side plate 27.

The gear 52 is engaged with a larger gear 58 on shaft 59 which extends to and is journaled in side plate 27 with a roller 59*a* thereon. The gear 58 is engaged with a gear 60 on shaft 61 which extends to and is journaled in side plate 27 with roller 61*a* thereon. The gear 60 is engaged with a gear 62 on shaft 63 which extends to and is journaled in side plate 27 and has a roller 63*a* thereon. The gear 62 is engaged with a gear 64 on a shaft 65 which extends to and is journaled in side plate 27 with a roller 65*a* thereon. If desired a liquid applying roller 66 may be provided on shaft 67 and a wiper roller 68 on shaft 69 journaled in plates 26 and 27.

The shaft 44 from gear 43 extends to and is journaled in plate 26 with a gear 70 thereon of smaller diameter than gear 43, which is engaged with gear 71 of larger diameter mounted on a shaft 72 which extends to and is journaled in side plate 27 with a roller 72*a* on shaft 72. The gear 71 is engaged with a gear 73 on shaft 74 extending to and journaled in plate 27 with a roller 74*a* thereon. The gear 73 is engaged with a smaller gear 75 on shaft 76 which extends to and is journaled in plate 27 with roller 76*a* thereon. The gear 71 is engaged with another gear 78 mounted on shaft 79 which extends to and is journaled in side plate 27 with roller 79*a* thereon. The gear 78 is engaged with a smaller diameter gear 80 mounted on a shaft 81 which extends to and is journaled in plate 27 with a roller 81*a* thereon.

The shaft 46 from gear 45 extends through and is journaled in plate 26, has a gear 85 thereon of smaller diameter than gear 45, which is engaged with a gear 86 of slightly larger diameter mounted on shaft 87 which extends to and is journaled in plate 27. The gear 86 is engaged with a larger diameter gear 88 on shaft 89 which extends to and is journaled in plate 27 with a roller 89*a* thereon. The gear 86 is also engaged with a larger diameter gear 90 on shaft 91 which extends to and is journaled in plate 27 with a roller 91*a* thereon. The gear 90 is engaged with a gear 92 on a shaft 93 extending to and journaled in plate 27 with a roller 93*a* thereon.

The shaft 51 from gear 50 extends to plate 26, is journaled therein, and has a smaller diameter gear 95 thereon, engaged as seen at the upper left in FIG. 1 with a smaller diameter gear 96 mounted on a shaft 97 journaled in side plate 26 and extending to and journaled in side plate 27 with a roller 97*a* thereon. The gear 96 is engaged with a still smaller diameter gear 100 mounted on a shaft 101 journaled in plate 26 and extending to and journaled in plate 27 with a roller 101*a* thereon. The gear 95 is also engaged at the left with a smaller diameter gear 102 mounted on shaft 103 journaled in plate 26, extending to and journaled in side plate 27 with roller 103*a* thereon. The gear 102 is engaged with a larger diameter gear 104 mounted on shaft 105, journaled in side plate 26, extending to and journaled in side plate 27 with a roller 105*a* thereon. The gear 95 is engaged at the right as seen in FIG. 1 with a gear 106 of smaller diameter mounted on shaft 107, journaled in plate 26, extending to and journaled in plate 27 with a roller 107*a* thereon. The gear 106 is engaged with a gear 108 mounted on shaft 109 journaled in plate 26, extending to and journaled in plate 27 with a roller 109*a* thereon.

The gear 95 is also engaged with a much larger diameter gear 110 mounted on shaft 111 journaled in plate 26, extending to and journaled in plate 27. The gear 110 has a plurality of smaller diameter gears 112 engaged therewith around its outer perimeter mounted on shafts 114, journaled in plate 26, extending to and journaled in plate 27, with gears 115 mounted thereon outside of plate 27. Rollers 114*a* are provided on the shafts 114 between the side plates 26 and 27.

Figure 2:
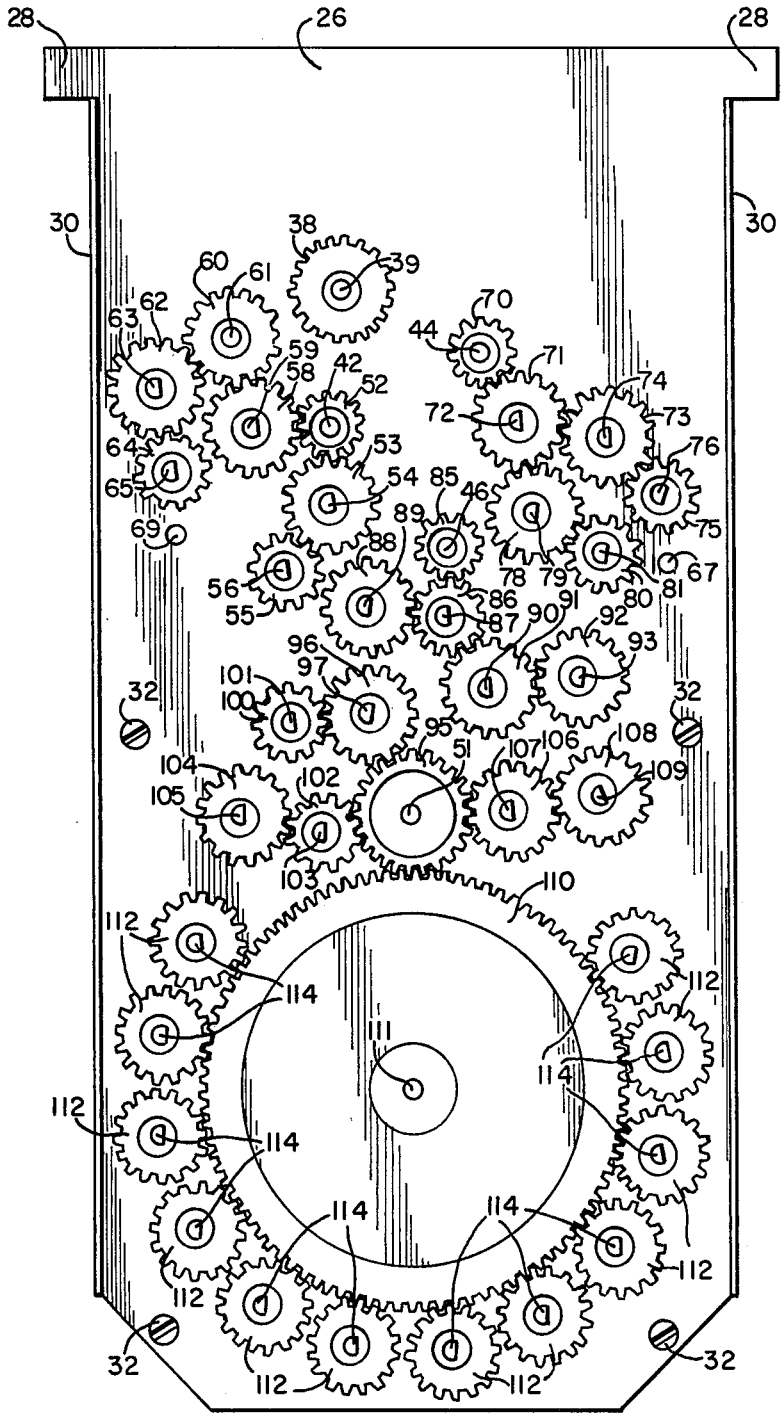
FIG. 2 is an end view of the roller transport rack of FIG. 1 as seen from the left end of FIG. 1.
Figure 3:
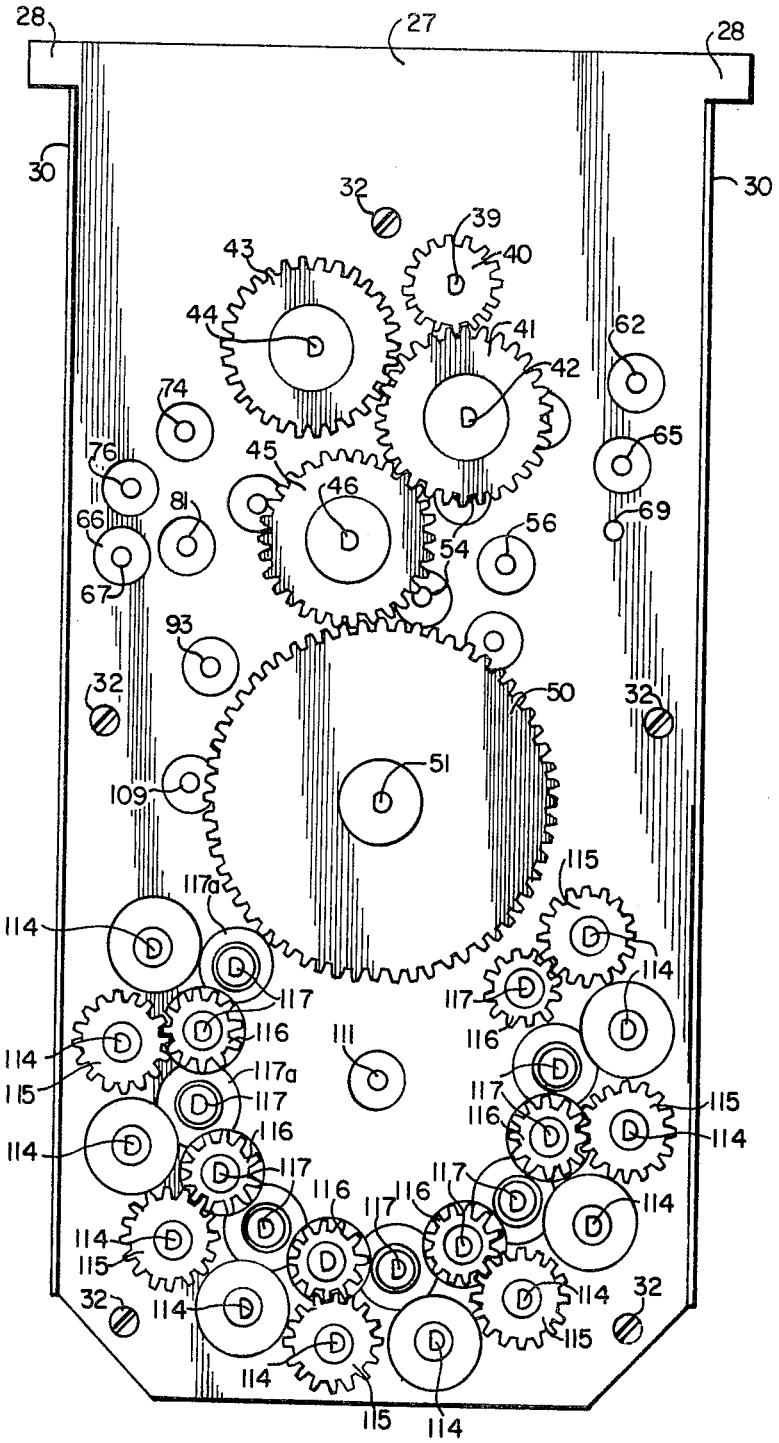
FIG. 3 is an end view of the roller transport rack of FIG. 1 as seen from the other end.
Figure 4:
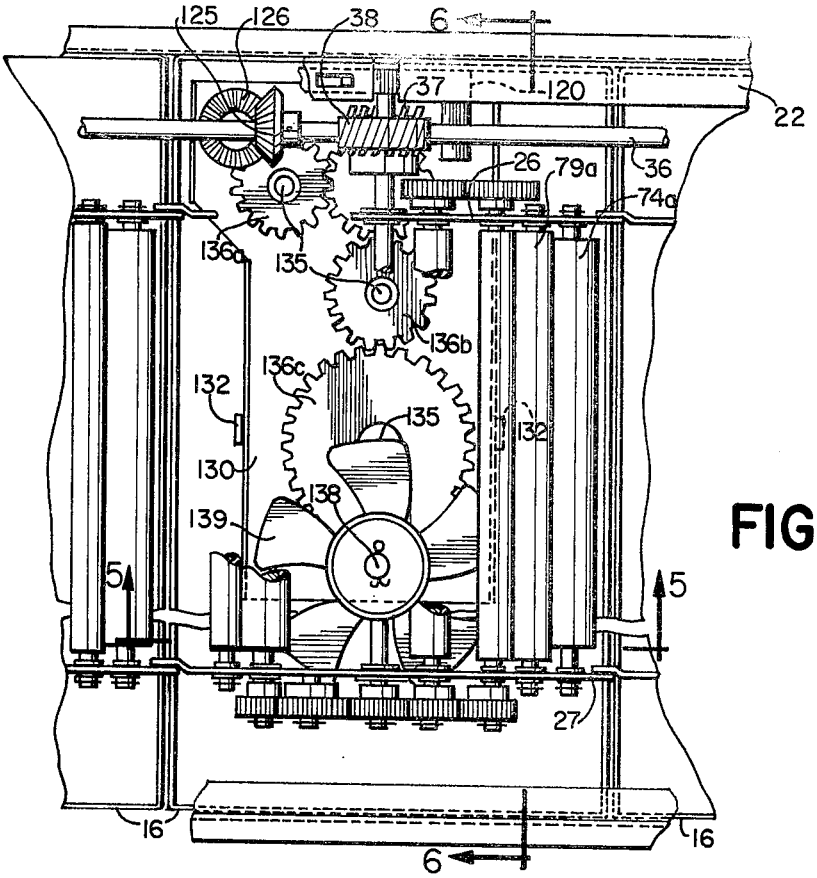
FIG. 4 is a top plan view of the processing equipment of the invention with the rack of FIG. 1 in place and with parts being broken away to show interior details of the agitating apparatus.
Figure 5:
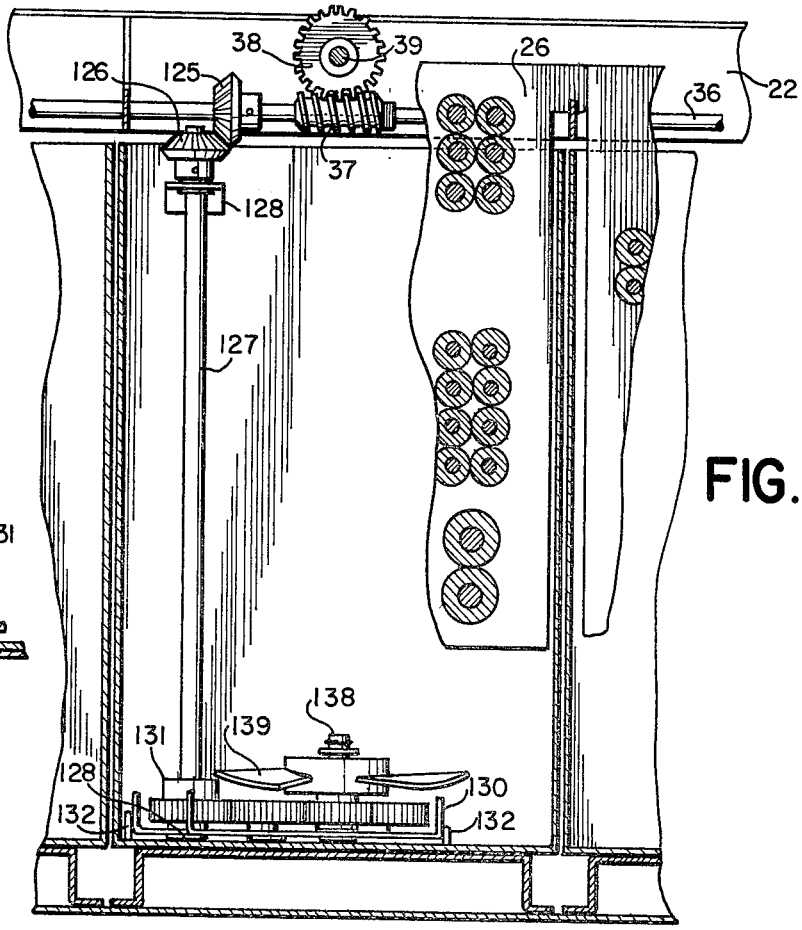
FIG. 5 is a vertical sectional view taken approximately on the line 5—5 of FIG. 4.
Figure 7:
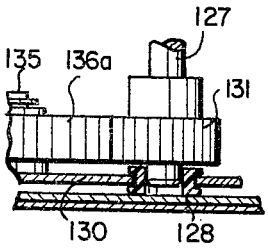
FIG. 7 is a vertical sectional view, enlarged, taken approximately on the line 7—7 of FIG. 6.
Figure 6:
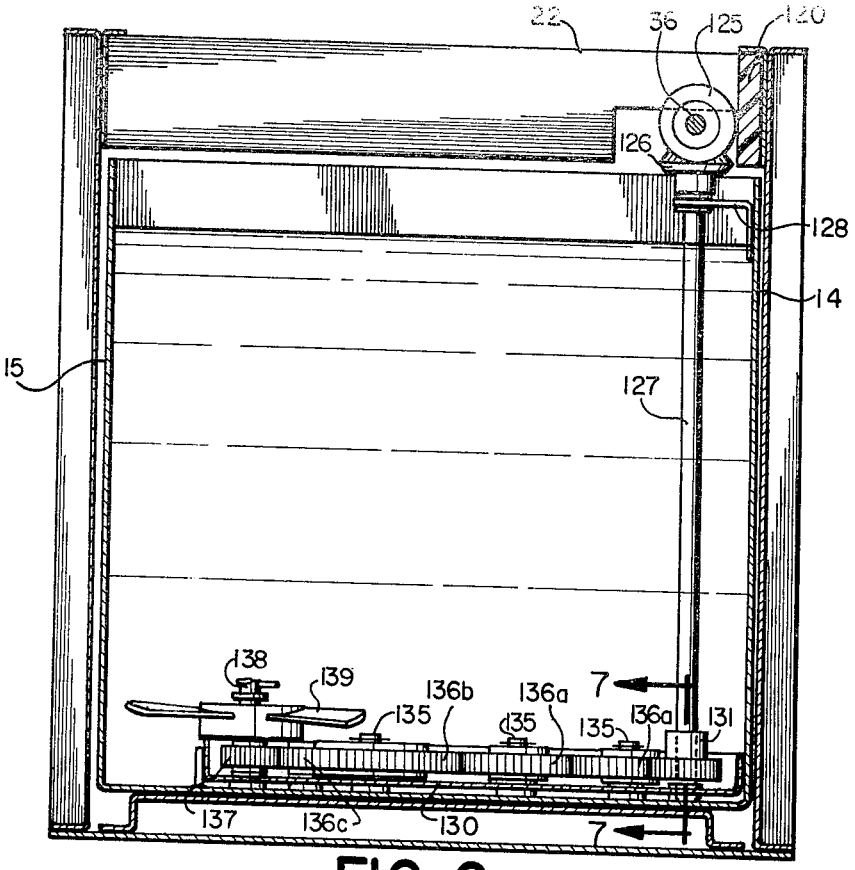
FIG. 6 is a vertical sectional view taken approximately on the line 6—6 of FIG. 4.

At the end of the rack as seen in FIG. 2 the gears 115 are shown with alternate ones of them engaged with gears 116 mounted on shafts 117 spaced inwardly from the shafts 114 and journaled in plates 27 and 26 with rollers 117*a* thereon. The description of the rack heretofore shown with a U-shaped turn around, staggered roller configuration and with alternate end gearing is one suggested embodiment of rack used with the invention and is shown and described more fully in our U.S. Pat. No. 4,026,451, however other suitable racks may be used as desired.

One preferred form of drive for the agitating elements will now be described in detail.

Upon reference to FIGS. 4 to 7, inclusive, it will be seen that the shaft 36, adjacent the worm gear 37, has a gevel gear 125 thereon, which is engaged with a bevel gear 126 on vertically disposed shaft 127. The shaft 127 is journaled in an L-shaped bracket 128 which is fastened to the side wall 14 of the tank 10. The shaft 127 at its lower end (see FIG. 7) is removably journaled in a bearing 128 carried in a gear train or transmission plate 130 and has a gear 131 secured thereto which can rest on the bearing 128. The plate 130 is preferably positioned by the tank wall 14, spaced side abutments 132 and an end abutment 133 in a notch 134, and is supported on the bottom wall 16 of the tank 10.

The plate 130 preferably has a plurality of upright shafts 135 secured thereto for carrying a plurality of interposed gears 136*a*, 136*b*, 136*c* in a gear train on the plate 130.

The last gear 136 meshes with a gear 137 on a shaft 138, the gear 137 having secured thereto for rotation therewith a fluid impeller 139 having a plurality of blades carried by a central hub. The ratio of the number of teeth on the gear 131 to the number of teeth on the gear 137 will determine the speed of rotation of the impeller 139. If the shaft 36 rotates at 60 rpm, the gear 131 has 18 teeth and the gear 137 has 10 teeth, then the impeller 139 will be driven at 90 rpm which is considered a relatively low speed.

The impeller 137 is preferably rotated at a speed which will provide adequate circulation of the liquid in the tank and speeds in the range of 70 to 200 rpm has been found suitable.

The number and sizes of interposed gears 136*a*, 136*b*, 136*c*, etc. may be used to determine the speed of rotation of the impeller 139 and also to determine the direction of rotation of the impeller 139. For some purposes it is preferred to drive the impeller 139 to circulate liquid upwardly through the transport racks 25 while for other purposes a downward flow is desired.

Any other preferred driving connection may be employed between the gear 131 and the gear 137 to provide the desired speed and direction of rotation of the impeller 139 for agitation of the liquid in the tank.

Figure 8:
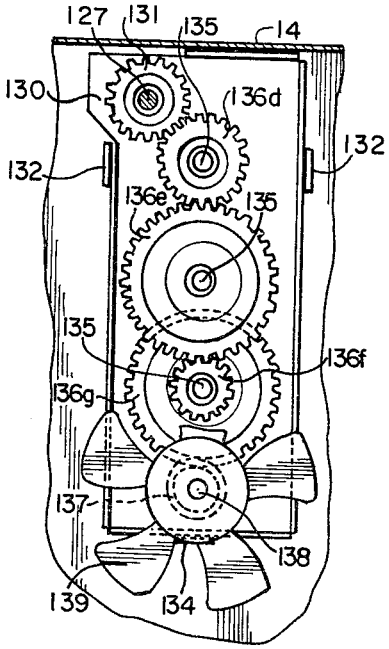
FIG. 8 is a fragmentary plan view of a different gear train for operating the agitator.

In FIG. 8, a gear train is illustrated to obtain a more rapid rotation of the impeller 139 for greater agitation.

The gear 131 meshes with a gear 136*d* on a shaft 135, which in turn meshes with a gear 136*e* on a shaft 135. The gear 136*c* meshes with a small gear 136*f* on a shaft 135. The small gear 136*f* has a larger gear 136*g* connected thereto and driven thereby which meshes with the driving gear 137 for the impeller 139. With this train with an input rpm of 60, with gears 137, 136*d*, 136*e*, 136*f*, 136*g* and 137 having 18, 20, 36, 12, 36 and 12 teeth, respectively, a speed of 90 rpm would be made available for the impeller 139.

Figure 9:
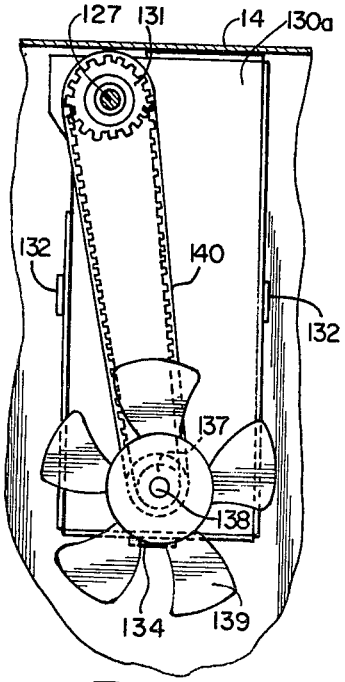
FIG. 9 is a fragmentary plan view of a different drive mechanism for operating the agitator.

In FIG. 9, a belt drive is illustrated carried on a transmission plate 130*a*. This drive employs an internally toothed belt 140 connecting the gear 131 on the shaft 127 which is journaled in the bearing 128 mounted on the transmission plate 130*a*, with the gear 137. The gear 137 is mounted on the shaft 138, carried by the plate 130*a* which drives the impeller 139. If gear 131 is provided with 24 teeth and gear 137 has 12 teeth the speed will be increased in the ratio of two to one. Any other suitable ratio may be employed.

Figure 10:
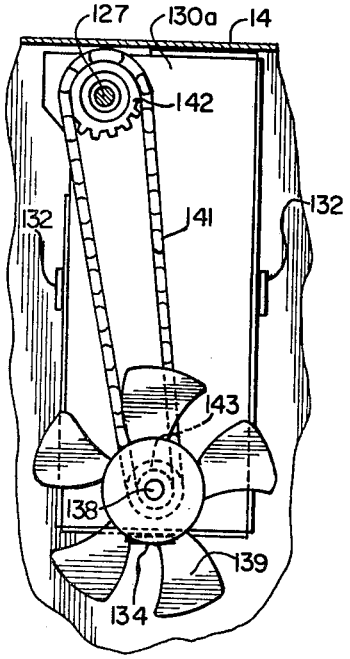
FIG. 10 is a fragmentary plan view of a still different drive mechanism for operating the agitator.

In FIG. 10, a chain drive is illustrated, carried on a transmission plate 130*a*. This drive employs a chain 141 of corrosion resistant metal or plastic connecting the sprocket 142, employed in place of the gear 131, on the shaft 127 with the sprocket 143, employed in place of the gear 137, on the shaft 138 to drive the impeller 139. If sprocket 142 has 24 teeth and sprocket 143 has 12 teeth the speed will be increased in the ratio of two to one. Any other suitable ratio may be employed.

We claim:

1. In photographic material processing equipment that includes at least one tank for containing a liquid for processing photographic material, a roller transport rack mounted in said tank, and power input means for driving said rack, the improvement which comprises liquid agitating means in the lower part of said tank comprising a rotatable bladed impeller, and power input means for driving said agitating means, said power input means including a power input shaft, and an additional shaft connected to and driven by said power input shaft, driving means interposed between said additional shaft and said impeller, said driving means determining the speed of rotation of said impeller.

2. In photographic material processing equipment that includes at least one tank for containing a liquid for processing photographic material, a roller transport rack mounted in said tank, and power input means for driving said rack, the improvement which comprises liquid agitating means in the lower part of said tank comprising a rotatable bladed impeller, and power input means for driving said agitating means, said power input means including a power input shaft, and an additional shaft connected to and driven by said power input shaft, driving means interposed between said additional shaft and said impeller, said driving means determining the direction of rotation of said impeller.

3. In photographic material processing equipment that includes at least one tank for containing a liquid for processing photographic material, a roller transport rack mounted in said tank, and power input means for driving said rack, the improvement which comprises liquid agitating means in the lower part of said tank comprising a rotatable bladed impeller, and power input means for driving said agitating means, said power input means including a power input shaft, and an additional shaft connected to and driven by said power input shaft, driving means interposed between said additional shaft and said impeller, said driving means comprising a driving belt.

4. In photographic material processing equipment that includes at least one tank for containing a liquid for processing photographic material, a roller transport rack mounted in said tank, and power input means for driving said rack, the improvement which comprises liquid agitating means in the lower part of said tank comprising a rotatable bladed impeller, and power input means for driving said agitating means, said power input means including a power input shaft, and an additional shaft connected to and driven by said power input shaft, driving means interposed between said additional shaft and said impeller, said driving means comprising a driving chain.

5. In photographic material processing equipment that includes at least one tank for containing a liquid for processing photographic material which tank has a bottom wall, a roller transport rack mounted in said tank for moving the photographic material downwardly and then upwardly in the tank, and power input means for driving said rack, the improvement which comprises liquid agitating means in the lower part of said tank, said agitating means including a vertical shaft and a rotatable bladed impeller mounted on said shaft and horizontally disposed on said shaft in spaced relation to the bottom wall of the tank, and power input means for driving said agitating means, said power input means comprising a vertical power input shaft extending downwardly within said tank, said first mentioned vertical shaft being parallel to said vertical power input shaft, and driving connections are provided between said vertical shafts.

6. The combination defined in claim 5 in which said vertical power input shaft and said first mentioned vertical shaft have driving gears therebetween.

* * * * *